US006568325B2

(12) United States Patent
Sawada et al.

(10) Patent No.: US 6,568,325 B2
(45) Date of Patent: May 27, 2003

(54) SUPPORTS FOR LITHOGRAPHIC PRINTING PLATES

(75) Inventors: Hirokazu Sawada, Shizuoka (JP); Akio Uesugi, Shizuoka (JP)

(73) Assignee: Fuji Photo Film Co., Ltd., Minami-Ashigara ( * ) Notice: Subject to any disclaimer, the term of this patent is extended or adjusted under 35 U.S.C. 154(b) by 0 days.

(21) Appl. No.: 09/818,900

(22) Filed: Mar. 28, 2001

(65) Prior Publication Data

US 2002/0029710 A1 Mar. 14, 2002

(30) Foreign Application Priority Data

Mar. 28, 2000 (JP) ..... 2000-088674
Mar. 28, 2000 (JP) ..... 2000-089337
Mar. 29, 2000 (JP) ..... 2000-091197

(51) Int. Cl.[7] ..... B41N 1/08; C22C 21/00
(52) U.S. Cl. ..... 101/459; 101/458
(58) Field of Search ..... 101/458, 459; 420/534, 535, 544, 550, 551; 148/438, 439; 428/472

(56) References Cited

U.S. PATENT DOCUMENTS 4,822,715 A * 4/1989 Shoji et al. ..... 430/302
4,861,396 A * 8/1989 Matsuo et al. ..... 101/459
5,104,743 A * 4/1992 Nishikawa et al. ..... 101/459
5,350,010 A * 9/1994 Sawada et al. ..... 164/476
5,711,827 A * 1/1998 Sawada et al. ..... 148/552
5,779,824 A * 7/1998 Sawada et al. ..... 148/437
5,795,541 A * 8/1998 Tanigawa et al. ..... 420/550
6,194,082 B1 * 2/2001 Sawada et al. ..... 420/551
6,337,136 B1 * 1/2002 Suzuki et al. ..... 428/472

FOREIGN PATENT DOCUMENTS

| | | |
|---|---|---|
| EP | 0 942 071 A1 | 9/1999 |
| EP | 0 978 573 A2 | 2/2000 |
| GB | 2 308 850 A | 7/1997 |
| JP | A 2000-37964 | 2/2000 |
| JP | A 2000-37965 | 2/2000 |

* cited by examiner

*Primary Examiner*—Stephen R. Funk
(74) *Attorney, Agent, or Firm*—Burns, Doane, Swecker & Mathis, LLP

(57) ABSTRACT

A support for lithographic printing plate which is obtained by performing surface roughening treatments including electrolytic graining on an aluminum alloy plate containing Fe, Si, Cu, Ti, Mg and Ni in specified amounts, with the balance being Al and incidental impurities. The Ni content, Cu content and the average surface roughness of the roughened support surface satisfy a specified relationship. A lithographic printing plate prepared from the support have longer press life, higher resistance to staining and better surface quality.

6 Claims, 2 Drawing Sheets

PRIOR ART

SUPPORTS FOR LITHOGRAPHIC PRINTING PLATES

FIELD OF THE INVENTION

This invention relates to supports for lithographic printing plates, particularly to supports that can be processed into lithographic printing plates having longer press life. More specifically, the invention relates to (1) supports that can be processed into lithographic printing plates having longer press life, higher stain resistance and better surface quality, (2) supports that can be obtained by the process comprising efficient electrochemical graining treatment and which can be processed into lithographic printing plates that have longer press life and which retain this property even after the plate surface is wiped with a plate cleaning solution, and (3) supports that can be processed into lithographic printing plates having longer press life and higher resistance to aggressive ink staining.

BACKGROUND OF THE ART

Photosensitive lithographic printing plates using aluminum alloy plates as supports are extensively used in offset printing. Such lithographic printing plates are prepared by processing presensitized plates. Generally, the presensitized plate is made by roughening the surface of an aluminum alloy plate, anodizing it, applying a photosensitive solution, and drying the applied coat to form a photosensitive layer. The presensitized plate is exposed imagewise, whereupon the exposed areas of the photosensitive layer change in physical properties. The photosensitive layer is then treated with a developer solution so that it is removed from the exposed areas (if the presensitized plate is positive-acting) or from the unexposed areas (if the presensitized plate is negative-acting). The areas from which the photosensitive layer has been removed are hydrophilic nonimage areas and the areas where the photosensitive layer remains intact are ink-receptive image areas. Thus, presensitized plates are processed into lithographic printing plates using the changes in the physical properties of the photosensitive layer that take place upon exposure.

The lithographic printing plate is then mounted on the plate cylinder for printing. In printing, an ink and a fountain solution are supplied to the surface of the plate. The ink adheres only to the image areas of the plate and the image is transferred to the blanket cylinder, from which it is transferred to the substrate such as paper, thereby completing the printing process.

Aluminum alloy plates are conventionally grained by three known techniques, mechanical (e.g. ball graining and brush graining), electrochemical (electrolytic etching with a liquid electrolyte based on hydrochloric acid, nitric acid, etc.; this technique is also hereunder referred to as "electrolytic graining"), and chemical (etching with an acid or alkali solution). Since the plate surfaces prepared by electrolytic graining have homogeneous pits and exhibit better printing performance, it is common today to combine the electrolytic graining method with another method such as mechanical graining or chemical graining.

By electrolytic graining, aluminum alloy plates acquire roughened surfaces that have not only "wavy" or "wrinkled" asperities to an average surface roughness Ra of about 0.30–1.0 $\mu$m but also pits in honeycomb or crater form that are about 0.2–20 $\mu$m in diameter and about 0.05–1 $\mu$m in depth. If the "wavy" or "wrinkled" asperities in the roughened surface obtained by the electrolytic graining method are not adequately uniform, it is preferably combined with the mechanical and/or chemical graining method to increase the uniformity of the asperities.

If the pits formed in the plate surface by graining are not uniform in diameter or depth, several defects occur and this problem is hereunder described with reference to FIGS. 1 and 2 which show schematically the cross-sectional structure of a conventional presensitized plate indicated by 10. As shown, the presensitized plate 10 consists of an aluminum alloy support plate 12 having pits P formed in its surface which in turn is coated with a photosensitive layer 14. First suppose that the pits P do not have uniform depth in the direction of exposure (see FIG. 1A); if the area where a deeper pit P' is formed is exposed, halation (nonuniform scattering of light) occurs (see FIG. 1B) and not only the exposed areas but also the unexposed areas change in physical properties (see FIG. 1C). This may produce "fog" in the printed image. If the presensitized plate is exposed over a wide area including pits P and the deeper pit P' (see FIG. 2A), the exposure at the bottom of the pit P' which is far from the light source (see FIG. 2B) may turn out insufficient to produce a yet-to-be exposed portion in the "exposed areas" (see FIG. 2C). The areas from which the photosensitive layer have been removed should inherently become nonimage areas but on account of such yet-to-be exposed portion, the nonimage areas will partly show the characteristics of the image areas. This portion is most likely to become the start point for staining to occur during printing.

Another problem with the nonuniformity of the asperities in the roughened plate surface is decreased adhesion between the photosensitive layer and the support, which in turn leads to a shorter press life of the lithographic printing plate. While direct imaging presensitized plates (for laser platemaking) are drawing increasing attention these days, longer press life is more desired since the adhesiveness of the photosensitive layer to the support is more susceptible than the photosensitive layer of the conventional presensitized plate which requires photographic films during platemaking. Uniformity of the asperities in the plate surface is extremely important to laser platemaking since insufficient exposure is all the more likely to occur.

Therefore, when roughening the surface of an aluminum alloy plate, pits that have appropriate depth and diameter and which are uniform in size must be generated uniformly in the entire surface of the support so that the photosensitive layer adheres strongly to the support while allowing the aluminum alloy plate to hold more water. The deeper the pits, the stronger the adhesion between the photosensitive layer and the support.

As mentioned above, the nonuniformity of the roughened surfaces of supports for lithographic printing plates have considerable effects on press life and other parameters to the printing performance of lithographic printing plates. In order to deal with this problem, many proposals have been made that try to eliminate the nonuniformity by changing the aluminum alloy composition of the plates. Many proposals have also been made concerning the waveform and frequency of the power supply for electrolytic graining.

In offset printing, ink is not directly transferred from the plate onto the substrate such as paper; instead, as shown in FIG. 3, ink 4 on the lithographic printing plate 1 wrapped around a plate cylinder 5 is first transferred to an elastic rubber coat (blanket 2) wrapped around a transfer cylinder 6 and the blanket 2 carrying the layer of ink 4 and the substrate 3 supplied by an impression cylinder 7 are brought into contact under sufficient pressure to perform printing.

If the pits in the nonimage areas are not uniform, the fountain solution is only insufficiently held in the nonimage areas to prevent the ingress of ink which, therefore, adheres to the nonimage areas of the plate surface to stain it. The stain is transferred to the blanket and eventually appears as stain on the print. In order to prevent this problem of stained prints, the pressman who has noted a stain on the blanket usually stops the press, cleans off the ink from the nonimage areas and supplies an increased amount of the fountain solution to prevent further staining of the plate surface. Cleaning is done by wiping the entire plate surface including both image and nonimage areas with a sponge imbibed with a suitable amount of an acidic or alkali liquid plate cleaner. This removes the ink adhering to the nonimage areas of the plate surface.

However, cleaning the entire plate surface with the liquid plate cleaner has its own problems. The applied liquid cleaner either swells the photosensitive layer to lower its strength or permeates between the photosensitive layer and the support to reduce their adhesion. If the cleaned plate is used to print many copies, wear or separation of the photosensitive layer is likely to occur in the solid image areas that are extensively rubbed with the blanket or in the highlight areas which adhere only slightly to the support. Therefore, lithographic printing plates are required to retain long press life even after their surface is cleaned with a liquid plate cleaner (this characteristic is also hereunder referred to as "press life after cleaner application").

As already mentioned, the adhesion between photosensitive layer and support is an important factor to providing lithographic printing plates with longer press life both before and after cleaner application. This adhesion is greatly influenced by pit depth, diameter, their uniformity, as well as the uniformity in distribution of the pits in the support surface and the density of their distribution and many R&D efforts have been made to improve these factors. An additional recent requirement is for lower cost in graining treatments; to meet this need, it is desired to generate the intended pits within a shorter period of time by raising the efficiency of electrolytic etching in the electrolytic graining treatment.

With a view to producing uniform roughened surfaces on supports for lithographic printing plates, it has been proposed that uniform graining by electrolytic etching be ensured by incorporating 0.05–0.1 wt % of Cu in an aluminum alloy support containing 0.05–1 wt % of Fe and 0.01–0.15 wt % of Si (JP-A-11-99763).

According to another proposal, it is described that the Fe, Si and Cu levels in an aluminum alloy support are adjusted to the ranges of 0.05–1 wt %, 0.015–0.2 wt % and ≦0.001 wt %, respectively, with the distributed elemental Si level in the metal structure being regulated to 0.015 wt % or more and the uniformity in surface roughening by electrolytic etching, fatigue strength and burning characteristics are improved (JP-A-11-99764).

According to yet another proposal, it is described that the Fe, Si and Cu levels in an aluminum alloy support are adjusted to the ranges of 0.05–1 wt %, 0.015–0.2 wt % and 0.001–0.05 wt %, respectively, with the distributed elemental Si level in the metal structure being regulated to 0.015 wt % or more and no streaks occur and uniformity in surface roughening by electrolytic etching, fatigue strength and better burning characteristics are improved (JP-A-11-99765). This method produces uniform pits by a short period of electrolytic graining treatment.

According to a further proposal, it is described that the Fe, Si and Ti levels in an aluminum alloy support are adjusted to 0.20–0.6 wt %, 0.03–0.15 wt % and 0.005–0.05 wt %, respectively, with part or all of these elements forming intermetallic compounds and the number of the grains of said intermetallic compounds present on the surface and of a size between 1 and 10 $\mu$m being regulated to 1000–8000 grains/mm$^2$ and pits can be formed by a short period of electrolytic graining treatment without producing unetched areas and uniform pits can be formed by roughening treatment even if they are shallow (JP-A-11-115333).

It has also been proposed that roughening pits be formed uniformly by adjusting the Fe, Si, Ti and Ni levels in an aluminum alloy support to 0.20–0.6 wt %, 0.03–0.15 wt %, 0.005–0.05 wt % and 0.005–0.20 wt %, respectively, with part or all of these elements forming intermetallic compounds which are regulated to contain Al, as well as Fe, Si and Ni in respective amounts of 20–30 wt %, 0.3–0.8 wt % and 0.3–10 wt % (JP-A-9-279272).

It has also been proposed that roughening pits be formed uniformly by adjusting the Fe, Si, Ti, Ni, Ga and V levels in an aluminum alloy support to 0.20–0.6 wt %, 0.03–0.15 wt %, 0.005–0.05 wt %, 0.005–0.20 wt %, 0.005–0.05 wt % and 0.005–0.020 wt %, respectively, with the Ti, Ga and V contents being regulated to satisfy the relation $1 \leqq ([Ti]+[Ga])/[V] \leqq 15$, where [Ti], [Ga] and [V] represent the contents (wt %) of Ti, Ga and V, respectively (JP-A-9-279274).

According to yet another proposal, it is described that the Fe, Si and Cu levels in an aluminum alloy support are adjusted to the ranges of 0.05–1 wt %, 0.01–0.2 wt % and ≦0.031 wt %, with either Ni or Cr or both being contained in an amount of 0.003–0.1 wt % and uniformity in surface roughening by electrolytic etching are improved (JP-A-11-D99760).

Also proposed is an aluminum alloy plate that contains Fe, Si, Ti and Ni in respective amounts of 0.20–0.6 wt %, 0.03–0.15 wt %, 0.005–0.05 wt % and 0.005–0.20 wt %, with either Cu or Zn or both being contained in an amount of 0.005–0.05 wt % and at least one element of the group consisting of In, Sn and Fb being contained in an amount of 0.001–0.020 wt % (JP-A-9-272937). Using this aluminum alloy plate, one can generate uniform pits by a short duration of electrolytic graining treatment.

However, if the Cu content of aluminum alloy supports is zero or very small (≦0.001 wt %) as proposed in JP-A-11-115333, JP-A-11-99764, JP-A-9-279272, JP-A-9-279274 and JP-A-11-99760, supra, no deep enough pits are generated and the supports have short press life and low stain resistance. Also problematic is the micro-streaking (unevenness in the form of very fine streaks) that results from low Cu levels.

The aluminum alloy support proposed in JP-A-11-99765, supra has such a large content (≧0.015 wt %) of elemental Si (which is one of the four forms in which Si occurs in aluminum alloy supports) that defects will readily develop in the anodized coat, leading to frequent occurrence of aggressive ink staining. The term "aggressive ink staining" will be explained later in detail and suffice it here to say that when printing is done with the occurrence of many interruptions, the nonimage areas of the lithographic printing plate have so much increased ink receptivity on the surface that stain appears as spots or rings in the print (e.g. paper) and this stain is referred to as "aggressive ink staining".

Conversely, if aluminum alloy supports contain Cu in large amounts (≧0.05 wt %) as proposed in JP-A-11-99763, there is no problem of "micro-streaking" which occurs in the case of low Cu content but, on the other hand, no uniform electrolytic graining can be achieved and "yet-to-be etched", or undergrained, areas are prone to occur, leading particularly to poor stain resistance.

The supports having such undergrained areas suffer from the disadvantage of deteriorated surface quality since they have fine glossy areas on the surface.

According to JP-A-9-272937, the support that has no "yet-to-be-etched" areas caused by insufficiency of electrolytic graining and has highly uniform grained surface observed by SEM can be obtained by a short duration of electrolytic graining treatment. However, the test about printing performance was not done. As it was put to the test actually, printing performance, particularly press life that requires the adhesion between photosensitive layer and support, more particularly press life after cleaner application was insufficient.

The Assignee previously proposed that an aluminum alloy support containing 0.05–0.5 wt % of Fe, 0.03–0.15 wt % of Si, 0.006–0.03 wt % of Cu and 0.010–0.040 wt % of Ti, with at least one of 33 elements including Li, Na, K and Rb being contained in an amount of 1–100 ppm and with the purity of Al being regulated to 99.0 wt % or higher, should be subjected to graining treatments including electrolytic graining so as to produce a support for lithographic printing plates that has been grained with high efficiency to give a very high degree of uniformity in the grained surface (JP2000-37965A).

The thus produced support for lithographic printing plates had high uniformity in pits, or highly uniform grained surface, and lithographic printing plates prepared from this support had longer press life and other improvements in printing performance. However, even this support could not necessarily be processed into a lithographic printing plate having satisfactory resistance to aggressive ink staining.

This is not a prior art, but the Assignee filed Japanese Patent Application 11-349888 and taught that when the aluminum alloy support disclosed in JP2000-37965A, namely, the one containing specified amounts of Fe, Si, Cut Ti and at least one of 33 elements including Li, Na, K and Rb, was modified by further incorporating a specified amount of Mg, its surface could be uniformly roughened by electrochemical graining to provide a support for lithographic printing plates that was suitable for platemaking using a laser light source.

Even this support could not necessarily be processed into a lithographic printing plate having satisfactory resistance to aggressive ink staining.

SUMMARY OF THE INVENTION

Therefore, a first object of the invention is to provide an aluminum alloy support for lithographic printing plates which can be processed into lithographic printing plates having longer press life, higher resistance to staining and better surface quality.

A second object of the invention is to provide an aluminum alloy support for lithographic printing plates that can be obtained by the process comprising efficient surface roughening by electrolytic graining and which can be processed into lithographic printing plates having longer press life both before and after application of a liquid plate cleaner.

A third object of the invention is to provide an aluminum alloy support for lithographic printing plates which can be processed into lithographic printing plates having longer press life and higher resistance to aggressive ink staining.

The present inventors started with the conventional aluminum alloy support containing Fe, Si, Cu and Ti as essential ingredients, They additionally incorporated Mg as an essential ingredient and further incorporated a specified amount of Ni as yet another essential ingredient. Then, in accordance with the value of the average surface roughness Ra of the support surface that was to be achieved by graining, the contents of Cu and Ni were adjusted to lie within specified ranges. As a result, large and deep graining pits could be generated uniformly to leave no residual fine glossy areas on the support which hence could be processed into lithographic printing plates having longer press life, higher resistance to staining and better surface quality. Thus, the first object of the invention could be attained.

According to its first aspect, the present invention provides a support for a lithographic printing plate which is obtained by performing surface roughening treatment including electrochemical graining on an aluminum alloy plate containing 0.2–0.5 wt % of Fe, 0.04–0.20 wt % of Si, 0.005–0.040 wt % of Cu, 0.010–0.040 wt % of Ti, 0.001–0.020 wt % of Mg and 0.005–0.2 wt % of Ni, with the balance being Al and an incidental impurity, and which satisfies the following relation (1):

$$[Ni]/10+[Ra]/100 \leqq [Cu] \quad (1)$$

where [Ni] and [Cu] are the Mi and Cu contents (wt %), respectively, of said aluminum alloy plate, and [Ra] is the average surface roughness Ra ($\mu$m) of the roughened support surface.

The present inventors also started with the conventional aluminum alloy support containing Fe, Si, Cu and Ti as essential ingredients. They additionally incorporated Mg as an essential ingredient and further incorporated 0.001–0.05 wt % in total of at least one element selected from among In, Pb, Sn, Bi, Cr, Mn and Zn. As a result, a support for lithographic printing plates in which the depth and diameter of pits generated by electrolytic graining (hereunder sometimes referred to as "electrolytic graining pits"), the uniformity of these size parameters, the uniformity in distribution of these pits in the support surface and the density of their distribution were adjusted to lie within the desired ranges could be produced with a small quantity of electricity; the support could be processed into lithographic printing plates having longer press life before and after cleaning with a liquid plate cleaner. Thus, the second object of the invention could be attained.

According to its second aspect, the present invention provides a support for a lithographic printing plate which is obtained by performing surface roughening treatment including electrochemical graining on an aluminum alloy plate containing 0.2–0.5 wt % of Fe, 0.04–0.20 wt % of Si, 0.005–0.040 wt % of Cu, 0.010–0.040 wt % of Ti, 0.001–0.020 wt % of Mg and 0.001–0.05 wt % in total of at least one element selected from among In, Pb, Sn, Bi, Cr, Mn and Zn, with the balance being Al and an incidental impurity.

The present inventors conducted extensive studies on the improvement of resistance to aggressive ink staining with a view to attaining the third object of the invention. As already mentioned, presensitized plates are a dual-layered structure consisting of an aluminum alloy support plate having pits formed in its surface and which is overlaid with a photosensitive layer, After imagewise exposure of the plate surface, development is performed to make nonimage areas from which the photosensitive layer has been removed and image areas where the photosensitive layer remains intact to record an image on the surface. For printing, ink and a fountain solution are supplied to the image-bearing lithographic plate, so that the fountain solution adheres to the nonimage areas and the ink adheres to the image areas, from which it is transferred to the substrate such as paper via a blanket.

If the printing operation is interrupted, the residual fountain solution in the nonimage areas evaporates slowly and the solutes become concentrated, sometimes attacking the anodized coat on the surface of the nonimage areas. As many interruptions occur, the surface of the nonimage areas having the anodized coat attacked by the solutes in the fountain solution loses hydrophilicity to become ink receptive and the problem of "aggressive ink staining" (the development of stains in the form of spots or rings on the substrate such as paper) occurs.

The Assignee found that the chlorine ions in the fountain solution took significant part in the phenomenon of aggressive ink staining and proposed a method of screening them out (JP-A-11-301241).

Making further studies on the problem of aggressive ink staining which would take place on aluminum alloy supports for lithographic printing plates that incorporated Mg as an essential ingredient in addition to Fe, Si, Cu and Ti contained as essential ingredients in the conventional aluminum alloy support, the present inventors noted that nonuniformity in pit depth was one of the causes of aggressive ink staining and found that uniformity in pit depth could principally be controlled by the Si content of the aluminum alloy plate and that only when it maintained a specified relationship with the Cu content could the Si content be an effective factor in controlling the uniformity of pit depth, The present inventors further found that if the nonimage areas had large water holding capacity (could hold more of the fountain solution on their surface), their surface was prone to be attacked during the above-described process of evaporation of the fountain solution; it was also found that the average surface roughness Ra was an effective characteristic value for expressing the water holding capacity of the nonimage areas. To be specific, the smaller the average surface roughness Ra, the smaller the water holding capacity and the less likely was the aggressive ink staining to occur. On the other hand, water holding capacity is a very important factor to the printing performance in other aspects and the present inventors found that an unduly small water holding capacity was not preferred and there was an advantageous range favoring a good balance between the various aspects of the printing performance. On the basis of these findings, the present inventors accomplished a support for lithographic printing plates that could attain the third object of the invention.

It was also found that if the Si content of the aluminum alloy plate was excessive, there was a high likelihood for Si itself to be the point at which the attack of the nonimage areas would start as the fountain solution evaporated, so there was a recognized need to control the Si content to lie within an appropriate range in accordance with the average surface roughness Ra. This finding also led to the accomplishment of the support for lithographic printing plates that could attain the third object of the invention.

In short, the present inventors found the following two facts about the aluminum alloy support for lithographic printing plates that incorporated Mg as an essential ingredient in addition to Fe, Si, Cu and Ti contained as essential ingredients in the conventional aluminum alloy support: the press life of the lithographic printing plate into which the support was processed and its resistance to aggressive ink staining could be controlled by adjusting the Cu and Si levels; the resistance of the plate to aggressive ink staining was influenced by the average surface roughness Ra. On the basis of these findings, the present inventors successfully obtained a support for lithographic printing plates that was free from the defects of the conventional lithographic support, which suffered only limited defects in the anodized coat and which, hence, could be processed into lithographic printing plates having markedly improved printability, longer press life and higher resistance to aggressive ink staining.

Thus, according to its third aspect, the present invention provides a support for a lithographic printing plate which is obtained by performing surface roughening treatment including electrochemical graining and anodization on an aluminum alloy plate containing 0.2–0.5 wt % of Fe, 0.04–0.20 wt % of Si, 0.005–0.040 wt % of Cu, 0.010–0.040 wt % of Ti and 0.002–0.020 wt % of Mg, with the balance being Al and an incidental impurity, and which has an average surface roughness Ra of 0.2–2.0 $\mu$m after said roughening treatments and which satisfies the following relation (2):

$$-2[Cu]+0.14-[Ra]/10 \leqq [Si] \leqq -[Cu]+0.22-[Ra]/10 \quad (2)$$

where [Si] and [Cu] are the Si and Cu contents (wt %), respectively, of said aluminum alloy plate, and [Ra] is the average surface roughness Ra ($\mu$m) of the roughened support surface.

In the support for lithographic printing plates according to the first, second or third aspects of the invention, said roughening treatments preferably include mechanical graining and/or chemical graining in addition to electrochemical graining.

DETAILED DESCRIPTION OF THE INVENTION

Figure 1A:
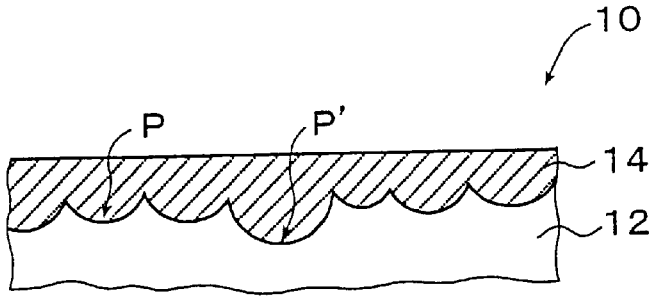
FIG. 1A is a cross section showing schematically an example of the interface between the support and the photosensitive layer of a conventional presensitized lithographic printing plate before exposure.
Figure 1B:
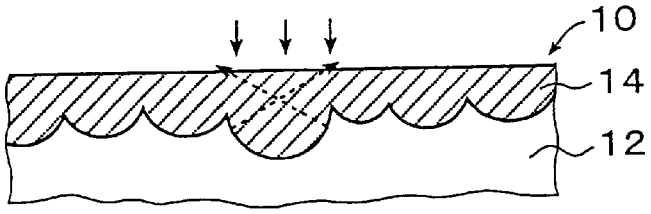
FIG. 1B is the same as FIG. 1A except that the plate is in the process of exposure.
Figure 1C:
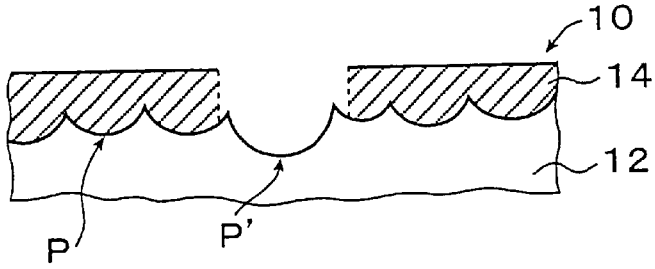
FIG. 1C is the same as FIG. 1A except that exposure has ended.
Figure 2A:
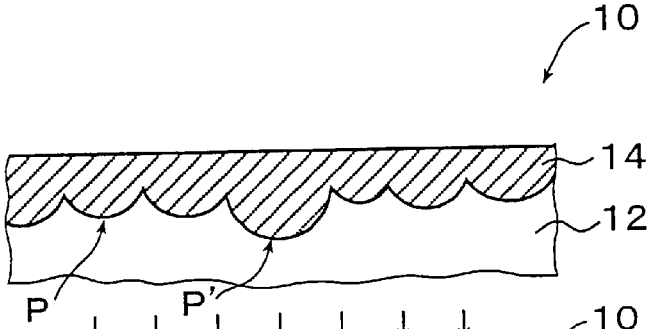
PRIOR ART FIG. 2A
FIG. 2A is a cross section showing schematically another example of the interface between the support and the photosensitive layer of a conventional presensitized lithographic printing plate before exposure.
Figure 2B:
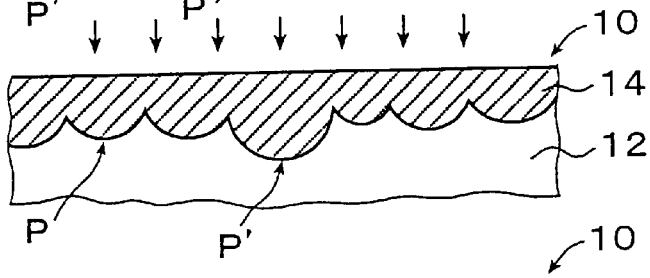
FIG. 2B is the same as FIG. 2A except that the plate is in the process of exposure.
Figure 2C:
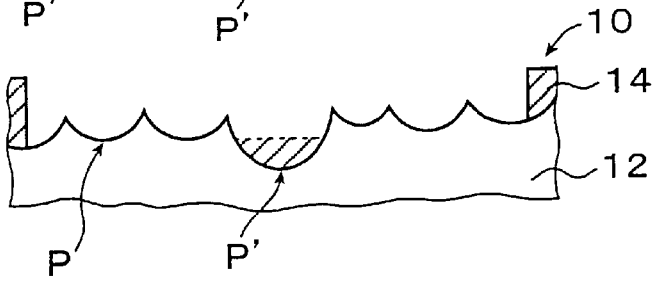
FIG. 2C is the same as FIG. 2A except that exposure has ended.
Figure 3:
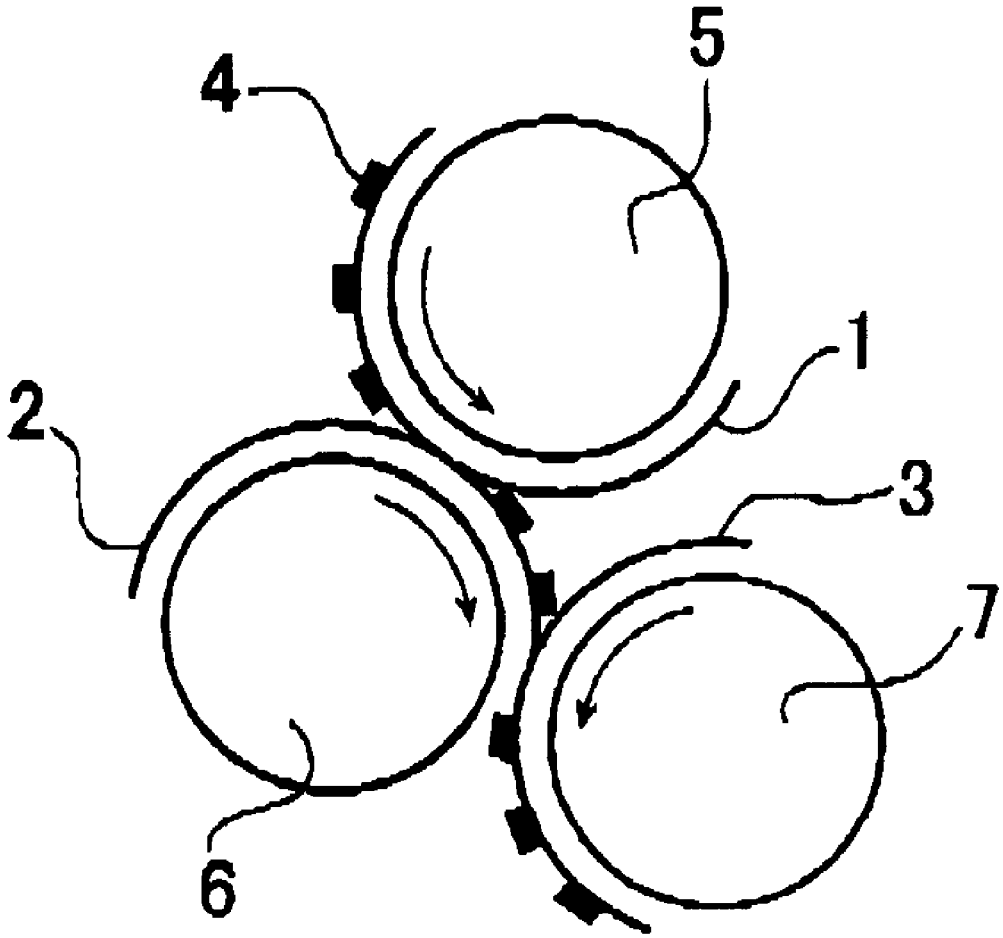
FIG. 3 is a cross section showing schematically an example of the offset printing cycle.

The present invention is described below in detail. The support for lithographic printing plates according to the present invention uses an aluminum alloy. In the first aspect of the invention, the aluminum alloy contains Al, Fe, Si, Cu, Ti, Mg and Ni as the essential ingredients and in the second and third aspects of the invention, Al, Fe, Si, Cu, Ti and Mg are the essential ingredients.

In the aluminum alloy, Fe binds with other elements to form Al—Fe base eutectic compounds. The Al—Fe base eutectic compounds not only refine recrystallized grains but also form a uniform electrochemically grained surface. If the Fe content is less than 0.2 wt %, no uniform grained surface may be obtained and pit uniformity may sometimes decrease due to insufficient electrochemical treatment (electrolysis). If the Fe content exceeds 0.5 wt %, coarse compounds may form, occasionally leading to nonuniform electrolytic graining. Therefore, the Fe content should be kept between 0.2 and 0.5 wt % in each of the first, second and third aspects of the invention.

Iron (Fe) has the ability to enhance the mechanical strength of the aluminum alloy. If the Fe content is less than 0.2 wt %, the mechanical strength of the aluminum alloy is so low that the lithographic plate prepared by processing the support is mostly likely to break when it is mounted on the plate cylinder of the press. Plate breakage is also likely to occur when many copies are printed at high speed.

If the Fe content exceeds 0.5 wt %, the strength of the ok aluminum alloy becomes higher than necessary and the lithographic plate prepared by processing the support has such poor fitting properties that after being mounted on the plate cylinder of the press, the plate may readily break during printing. If the support strength is a predominant factor, the Fe content is preferably adjusted to lie between 0.2 and 0.4 wt %. If the lithographic plate is intended for use in press proofing, the limitations about strength and fitting properties are not necessarily critical and the ranges set forth above may be slightly varied.

Silicon (Si) as it occurs in the aluminum alloy either dissolves in Al or forms precipitates of Al—Fe—Si intermetallic compounds or Si alone. The Si dissolved in Al has dual functions, one of providing a uniform electrochemically grained surface and the other of establishing uniformity in the electrolytic graining pits, chiefly in their depth. Si is contained as an incidental impurity in the base Al metal which is the starting material for the support and, in certain cases, the Si content is already at least 0.03 wt %. Therefore, Si levels less than 0.03 wt % are not practically feasible and in order to prevent variations from one lot of the starting material to another, intentional addition of Si is often made in very small amounts. If the Si content is less than 0.04 wt %, not only the above-mentioned dual functions of Si are unattainable but it is also necessary to prepare a high-purity and, hence, costly base Al metal; such low Si levels are therefore practically infeasible. If the Si content exceeds 0.20 wt %, the plate prepared by processing the support has only poor resistance to aggressive ink staining during printing. Therefore, in each of the first, second and third aspects of the invention, the Si content should lie within the range of 0.04–0.20 wt %, preferably 0.05–0.10 wt %.

In the third aspect of the invention, it is important that the Si content also satisfy a specified relationship with the Cu content. Stated specifically, [Si] (the Si content in wt %) and [Cu] (the Cu content in wt %) must satisfy the relation (2) set forth above, with [Ra] (the average surface roughness Ra in $\mu$m) being a constant (parameter). By satisfying the relation (2), one can achieve uniformity in the grained surface in such aspects as pit depth and diameter while providing higher resistance to aggressive ink staining. The relation (2) is derived from the Examples and Comparative Examples to be set forth later in this specification.

Copper (Cu) is a very important element for controlled electrolytic graining and contributes to improving the uniformity of electrolytic graining pits, chiefly the uniformity of their diameter. This is due to the ability of Cu to increase the diameter of electrolytic graining pits. Uniformity in pits is essential for better printability. If the Cu content is less than 0.005 wt %, the surface oxide coat in which pits are to be formed electrochemically may have such a low electric resistance that the formation of uniform pits is sometimes impossible. Conversely, if the Cu content exceeds 0.040 wt %, the surface oxide coat in which pits are to be formed electrochemically has such a high electric resistance that coarse pits are prone to form, Therefore, in each of the first, second and third aspects of the invention, the Cu content should lie within the range of 0.005–0.040 wt %, preferably 0.01–0.02 wt %.

In the third aspect of the invention, it is important that the Cu content satisfy the relation (2) with the Si content. By satisfying the relation (2), one can achieve uniformity in the grained surface in such aspects as pit depth and diameter.

Titanium (Ti) is conventionally contained in order to refine the crystal structure of the aluminum alloy as it is cast. If the Ti content exceeds 0.040 wt %, the surface oxide coat may have such a low electric resistance during electrolytic graining that the formation of uniform pits is sometimes impossible. Conversely, if the Ti content is less than 0.010 wt %, the crystal structure of the aluminum alloy being cast may not be sufficiently refined that even after it is finished to a thickness of 0.1–0.5 mm through various steps, the vestigial coarse crystal structure remaining after the casting operation may occasionally cause significant deterioration in appearance. Therefore, in each of the first, second and third aspects of the invention, the Ti content should lie within the range of 0.010–0.040 wt %, preferably 0.020–0.030 wt %. Titanium (Ti) is added as an Al—Ti alloy or an Al—B—Ti alloy.

Magnesium (Mg) has dual functions, one of refining the recrystallized structure of Al and the other of improving various mechanical strength characteristics such as tensile strength, yield, fatigue strength, flexural strength and resistance to heat softening. Mg helps achieve uniform pit distribution during electrolytic graining, so it is also an important ingredient that contributes to providing a uniform grained surface.

In the first and second aspects of the invention, the distribution of pits may deteriorate if the Mg content is less than 0.001 wt % and the same problem may occur if the Mg content exceeds 0.020 wt %. Therefore, the Mg content should lie within the range of 0.001–0.020 wt %, preferably 0.005–0.020 wt %, more preferably 0.008–0.020 wt %.

In the third aspect of the invention, if the Mg content is less than 0.002 wt %, pits may be distributed so poorly as to cause deterioration in the resistance to aggressive ink staining. The same problem may occur if the Mg content exceeds 0.020 wt %. Therefore, the Mg content should lie within the range of 0.002–0.020 wt %, preferably 0.005–0.020 wt %, more preferably 0.008–0.020 wt %.

In the first aspect of the invention, Nickel (Ni) is an essential ingredient of the alloy. Ni is capable of generating fine and uniform pits during electrolytic graining. If the Ni content is less than 0.005 wt %, it may sometimes fail to generate fine and uniform pits. Therefore, in the support for lithographic printing plates according to the first aspect of the invention, the Ni content should be within the range of 0.005–0.2 wt %, preferably 0.10–0.20 wt %.

In the first aspect of the invention, the Cu and Ni contents should not only be within the ranges specified above but also satisfy the relation (1) depending upon the average surface roughness Ra of the grained surface. If the relation (1) is satisfied, a support is obtained which can be processed into lithographic printing plates that are satisfactory in all three terms, press life, stain resistance and surface quality. The reasons for these beneficiary effects are described below.

As already mentioned, Cu and Ni are both pit controlling ingredients, provided that Cu controls the diameter of graining pits whereas the controlling effect of Ni depends on the formation of fine uniform graining pits.

The support for lithographic printing plates according to the first aspect of the invention has been treated by electrolytic graining and as will be mentioned later in this specification, electrolytic graining is preferably preceded by mechanical graining. Mechanical graining is a treatment which generally imparts large wavy components to the support surface, so if it is performed before electrolytic graining, the average surface roughness Ra increases but if is not performed, the average surface roughness Ra decreases.

Based on this knowledge, the present inventors obtained the following observation about the Cu and Ni contents and the average surface roughness Ra. If the average surface roughness Ra is relatively large, say, between 0.50 and 1.0 μm, the presence of many wavy components increases the surface area of the aluminum alloy plate, making it necessary to form many large pits. To this end, the Cu content is increased but the Ni content is decreased. If the average surface roughness Ra is relatively small, say, between 0.30 and 0.50 μm the presence of a limited number of wavy components decreases the surface area of the aluminum alloy plate. In this case, there is no need to form many large pits; on the other hand, the formation of excessively large pits must be prevented and to this end, the Cu content may be reduced.

Based on this finding, the present inventors made further studies in order to improve three items of plate performance, press life, stain resistance and surface quality, and found that the Cu content, Ni content and the average surface roughness Ra should satisfy the following relation (1); the first aspect of the present invention has been accomplished based on the finding of this relation:

$$[Ni]/10+[Ra]/100 \leq [Cu] \quad (1)$$

where [Ni] and [Cu] are absolute numbers that represent in wt % the Ni and Cu contents, respectively, of the aluminum alloy used in the support for lithographic printing plates, and [Ra] is an absolute number that represents in μm the average surface roughness Ra of the roughened support surface.

The term "average surface roughness Ra" as used herein means the value calculated by the following equation (3):

$$Ra = \frac{1}{L}\int_0^L |f(x)|dx \quad (3)$$

where y=f(x) represents a roughness curve. In the present invention, the cutoff value $\lambda_c$, for determining the roughness curve is chosen at 0.8 mm.

The support for lithographic printing plates according to the first aspect of the invention is characterized in that the individual ingredients in the aluminum alloy it employs are within the specified ranges and that the Cu and Ni contents satisfy the relation (1). It therefore has large, deep and uniform pits, features strong adhesion to the photosensitive layer and can be processed into lithographic printing plates having a sufficiently long press life. Since the pits are large and deep, the support can be processed into lithographic printing plates that have large water holding capacity and high stain resistance. What is more, the pits are sufficiently uniform to eliminate the occurrence of undergrained areas, so the support can be processed into lithographic printing plates having improved surface quality.

In addition to the above-mentioned essential alloy ingredients, the aluminum alloy used in the second aspect of the invention contains at least one element selected from among In, Pb, Sn, Bi, Cr, Mn and Zn (such element is also hereunder referred to as "trace alloy ingredient") is contained in a total amount of 0.001–0.05 wt %.

If added in small amounts, these trace alloy ingredients promote electrolytic etching in the electrolytic graining process and help generate a uniform distribution of pits over the entire surface of the support even with a small quantity of applied electricity. If the conventional aluminum alloy plate is subjected to electrolytic graining with a small quantity of electricity applied, uniform distribution of pits is realized but they are not deep enough that if the printing plate is subjected to many impressions or if it is cleaned with a liquid plate cleaner during printing, the solid image areas or the highlight image areas of the plate occasionally have shorter press life after application of a cleaner. This is not the case with the lithographic support according to the second aspect of the present invention and the pits generated by electrolytic graining are not only distributed uniformly but given the same quantity of electricity, they are deeper enough to extend the press life of the plate even after application of a cleaner.

The trace alloy ingredients suffice the purpose of the invention if they are added in a total amount of at least 0.001 wt % and adding them in a total amount exceeding 0.05 wt % is not economically advisable.

The aluminum alloys to be used in the invention preferably have an Al content (Al purity) of at least 99.0 wt %, more preferably at least 99.4 wt %.

In the first and third aspects of the invention, the content of incidental impurities can be calculated by subtracting the Al content and the above-specified contents of the essential alloy ingredients from the total of 100%. In the second aspect of the invention, the content of incidental impurities can be calculated by subtracting the Al content and the above-specified contents of the essential alloy ingredients and the above-specified content of the trace alloy ingredients from the total of 100%.

The mechanical strength of aluminum alloys depends on their Al purity and usually, low Al purity results in less flexible aluminum alloys. Therefore, if the Al content in the aluminum alloys to be used in the invention is lower than the range specified above, problems may sometimes occur when they are processed into lithographic printing plates as typified by poor mountahility on the press.

In order to work the aluminum alloys into plates, the following method can typically be employed. First, a melt of aluminum alloy adjusted to have specified contents of alloy ingredients is purified and cast by conventional methods. In the purification step, hydrogen, other unwanted gases and solid impurities in the melt are removed. The examples of purification process to remove the unwanted gases are fluxing process and degassing process using argon gas, chloride gas or the like. The examples of purification process to remove the solid impurities are filtering process using a so-called "rigid" media filter such as a ceramic tube filter or a ceramic foam filter, a filter using alumina flakes, alumina balls or some other filtering media, glass cloth filter or the like. Alternatively, the purification process can be applied by the combination of degassing process and filtering process.

In the next step, the molten aluminum alloy is cast by using either a fixed mold as in DC molding or a driven mold as in continuous casting. In the case of DC molding, ingots 300–800 mm thick are produced and a surface layer is removed by scalping by a thickness of 1–30 mm, preferably 1–10 mm. If necessary, soaking is subsequently performed. If soaking is to be done, heat is applied at 450–620° C. for 1–48 hours in order to prevent coarsening of intermetallic compounds. If the application of heat lasts for less than an hour, only insufficient soaking may occur.

Thereafter, the aluminum alloy plate is subjected to cold rolling and hot rolling. It is suitable to start hot rolling at 350–500 ° C. Intermediate annealing may be performed either before or after or during cold rolling. If intermediate annealing is to be performed, heat may be applied in a batchwise annealing furnace at 280–600° C. for 2–20 hours, preferably at 350–500° C. for 2–10 hours, or in a continuous annealing furnace at 400–600° C. for no more than 6 minutes, preferably at 450–550° C. for no more than 2 minutes. A finer crystal structure may be produced by heating at a rate of 10° C./sec or more in a continuous annealing furnace. The aluminum alloy plate finished to a predetermined thickness, say, 0.1–0.5 mm may be straightened by a roller leveler, a tension leveler or the like to have a higher degree of flatness. It is common practice to pass the plate through a slitter line so that it is worked to a predetermined plate width.

The aluminum alloy plate is subsequently grained to prepare a support for lithographic printing plates. The aluminum alloy plate of the invention is subjected to graining treatments including electrolytic graining which may be performed either alone or in combination with mechanical graining and/or chemical graining. Preferably, electrolytic graining is combined with mechanical graining and it is particularly preferred to perform electrolytic graining after mechanical graining.

Electrolytic graining can easily impart fine asperities (pits) to the surface of the aluminum plate and, hence, is suitable for making lith plates of good printability. Electrolytic graining is performed by applying either a dc or ac current through an aqueous solution mainly composed of nitric acid or hydrochloric acid.

By electrolytic graining, pits in crater or honeycomb form can be generated in the surface of the aluminum alloy plate at an area ratio (distribution density) of 30–100%. The pit size varies with the aspect of the invention; in its first aspect, the average diameter of the pits is approximately 0.2–20 $\mu$m; in the second aspect, the average depth of the pits is approximately 0.05–1 $\mu$m and their average diameter is approximately 0.2–20 $\mu$m; in the third aspect, the average diameter of the pits is et approximately 0.5–20 $\mu$m. Suitably sized pits help increase not only the resistance of the nonimage areas of lithographic printing plate to fouling (both stain resistance and resistance to aggressive ink stain) but also their press life. Electrolytic graining is also effective in forming wavy surfaces which preferably have an average surface roughness Ra of 0.35–1.0 $\mu$m.

In electrolytic graining, it is important that the quantity of electricity as expressed by the product of current and the time of its application should be sufficient to provide an adequate number of pits in the plate surface. Forming an adequate number of pits using less electricity is also preferred from the viewpoint of saving energy. In the present invention, the conditions for electrolytic graining are not limited in any particular way and it may be performed under customary conditions. Whichever conditions are adopted, the required quantity of electricity can be saved considerably. The required quantity of electricity varies with the desired pit depth, diameter, as well as uniformity in the distribution of pits and the density of their distribution. In the second aspect of the invention, an electrolytically grained plate surface having long enough press life both before and after application of a cleaner can be obtained if the quantity of electricity is within the range of 30–500 C./dm$^2$, preferably 100–300 C./dm$^2$.

By mechanical graining, the surface of the aluminum alloy plate is roughened to have "wavy" or "wrinkled" asperities which generally are about 10–2000 $\mu$m long and about 1–10 $\mu$m high. In this case, the plate surface typically has an average surface roughness Ra of 0.35–1.0 $\mu$m, preferably 0.40–0.80 $\mu$m Mechanical graining is more efficient than electrolytic graining in forming a "wavy" rough surface. The average surface roughness Ra is a factor that indicates the waviness of the support surface and the greater the value of Ra, the larger the surface asperities and the greater the water holding capacity of the support. Water holding capacity influences the interlinking of halftone dots which is one of the factors that affect stain resistance; therefore, the average surface roughness Ra essentially affects stain resistance. In the present invention, the conditions for mechanical graining are not limited in any particular way and it may be performed in accordance with the methods described in JP-B-50-40047. The pits to be formed may have the same shape and size as those formed by electrolytic graining. Chemical graining can also be performed by known methods without any particular limitations and as in mechanical graining, wavy asperities and pits are formed.

Subsequent to the graining step, the aluminum alloy plate is anodized so that its surface has increased wear resistance. Any electrolyte can be used in anodization as long as it can form a porous oxide film. Generally, sulfuric acid, phosphoric acid, oxalic acid, chromic acid or mixtures thereof are used. The concentration of the electrolyte is determined as appropriate for various factors including its kind. The conditions for anodization defy generalization since they vary considerably with the electrolyte used but the following may be given as guide figures: electrolyte concentration, 1–80 wt %; electrolyte temperature, 5–70° C.; current density, 1–60 A/dm$^2$; voltage, 1–100 V; electrolysis time, 10–300 seconds.

In order to provide higher stain resistance during printing, the electrolytically grained and rinsed aluminum alloy plate may be etched lightly with an alkali solution and rinsed. In order to remove any alkali-insoluble matter (smut) that remains on its surface, the plate may be desmutted with an acid such as sulfuric acid and rinsed before dc electrolysis is performed in sulfuric acid to form an anodized coat. If necessary, the anodized surface may be rendered hydrophilic with a suitable agent such as a silicate.

As the result of these procedures, the supports of the present invention for lithographic printing plates are provided. The lithographic support according to the first aspect of the invention has a uniform distribution of the large and deep pits that are generated by graining but it does not have any residual micro-fine glossy areas. Therefore, lithographic printing plates using this support perform well in printing and exhibit long press life, high stain resistance and good surface quality.

With the lithographic support according to the second aspect of the invention, one can choose suitable graining conditions to control the depth and diameter of the pits to be generated and, in addition, pits of uniform size can be generated in the support surface such that they are distributed uniformly at the desired density. Therefore, lithographic printing plates using this support have strong enough adhesion between the photosensitive layer and the support to feature long press life. This characteristic is retained even after the plate surface is cleaned with a liquid plate cleaner during printing. In addition, these features can be imparted at a substantially reduced cost of electrolysis.

In the lithographic support according to the third aspect of the invention, the wavy asperities and pits that are generated by graining are free from non-uniformity in shape and size, assuring strong adhesion between the photosensitive layer and the support. Therefore, lithographic printing plates using this support perform well in printing and exhibit long press life and high resistance to aggressive ink stain; in addition, they have a great water holding capacity and good mountability on the press.

In order to process the lithographic supports of the invention into presensitized plates, sensitizers can be applied to their surface and dried to form the photosensitive layer. The sensitizers that can be used are in no way limited and any types may be applied that are commonly used on presensitized plates. The thus presensitized plates are exposed imagewise with a lith film and subsequently developed and gummed to prepare lith plates that cart be mounted on the press. If the applied photosensitive layer has high enough sensitivity, direct imagewise exposure can be accomplished with a laser.

Any sensitizers may be employed as long as they change solubility or swellability in liquid developers upon exposure. Typical examples of sensitizers are listed below.

(A) Photosensitive Layer Composed of o-quinone Diazide Compounds

Positive-acting photosensitive compounds include o-quinone diazide compounds typified by o-naphthoquinone diazide compounds. A preferred o-naphthoquinone diazide compound is described in JP-B-43-28403 and it is the ester of 1,2-diazonaphthoquinone-sulfonic acid chloride and a pyrogallol-acetone resin. Also preferred is the ester of 1,2-diazonaphthoquinonesulfonic acid chloride and a phenol-formaldehyde resin which is described in U.S. Pat. Nos. 3,046,120 and 3,188,210. Other known kinds of o-naphthoquinonediazide compounds are also useful.

Particularly preferred o-naphthoquinonediazide compounds are those obtained by reacting polyhydroxy compounds of no more than 1,000 in molecular weight with 1,2-diazonaphthoquinonesulfonic acid chloride. Preferably, the polyhydroxy compound is reacted with 0.2–1.2 equivalent amounts, more preferably 0.3–1.0 equivalent amount, of 1,2-diazonaphthoquinonesulfonic acid chloride assuming that the hydroxy groups in the polyhydroxy compound are in One equivalent amount. A preferred 1,2-diazonaphthoquinonsulfonic acid chloride is 1,2-diazonaphthoquinone-5-sulfonic acid chloride although 1,2-diazonaphthoquinone-4-sulfonic acid chloride is also useful.

The o-naphthoquinonediazide compounds are mixtures in which the 1,2-diazonaphthoquinonesulfonic acid chloride has substituents introduced in different positions and amounts. Preferably, the content of the complete ester in the mixture (i.e., the proportion of the mixture that is assumed by a compound in which all hydroxy groups present have been converted to the 1,2-diazonaphthoquinonesulfonic acid ester) is at least 5 mol %, more preferably between 20 and 90 mol %, most preferably between 20 and 99 mol %.

Instead of the o-naphthoquinonediazide compounds, polymers having o-nitrocarbinol ester groups as described in JP-8-56-2696 may be used as positive-acting photosensitive compounds. Also useful are systems in which compounds that generate acids upon photodegradation are combined with compounds having acid-dissociable —C—O—C— or —C—O—Si— groups. For example, a compound that generates an acid upon photodegradation may be combined with acetal or O,N-acetal compound (JP-A-48-89003), an orthoester or an amide acetal compound (JP-A-51-120714), a polymer having acetal or ketal groups in the backbone chain (JP-A-53-133429), an enolether compound (JP-A-55-12995), an N-acyliminocarbon compound (JP-A-55-126236), a polymer having ortho-ester groups in the backbone chain (JP-A-56-17345), a silyl ester compound (JP-A-60-10247), or a silylether compound (JP-A-60-37549 and JP-A-60-121446).

The positive-acting photosensitive compound (which may be in the combination system described above) preferably assumes 10–50 wt %, more preferably 15–40 wt %, of the photosensitive composition in the photosensitive layer.

The photosensitive layer may solely be composed of o-quinonediazide compounds but the latter are preferably used together with binder resins that are soluble in aqueous alkalis. Binder resins that are soluble in aqueous alkalis include: cresol-formaldehyde resins such as novolaks, phenol-formaldehyde resins, m-cresol-formaldehyde resins, p-cresol-formaldehyde resins, m-/p-mixed cresol-formaldehyde resins and phenol/cresol mixed (which may be m-, p- or m-/p-mixed)-formaldehyde resins; phenol modified xylene resins; polyhydroxystyrene and polyhalogenated hydroxystyrene; acrylic resins having phenolic hydroxy groups as disclosed in JP-A-51-34711; acrylic resins having suifonamido groups as described in JP-A-2-866; and urethane-base resins. The binder resins that are soluble in aqueous alkalis preferably have weight average molecular weights of 500–20,000 and number average molecular weights of 200–60,000.

The binder resins that are soluble in aqueous alkalis are contained in such amounts that they assume no more than 70% of the total mass of the photosensitive composition. As described in U.S. Pat. No. 4,123,279, resins such as t-butyl phenol-formaldehyde resin and octyl phenol-formaldehyde resin that are obtained by polycondensation of formaldehyde and phenol having a $C_{3-8}$ alkyl group as a substituent may be used with the binder resins soluble in aqueous alkalis and this is preferred for the purpose of improving the ink receptivity of the image areas.

The photosensitive composition may further contain various substances such as sensitivity enhancing cyclic acid anhydrides, print-out agents for providing visible image right after exposure, dyes as image colorants, and other fillers. Exemplary cyclic acid anhydrides that can be used are described in U.S. Pat. No. 4,115,128 and include phthalic anhydride, tetrahydrophthalic anhydride, hexahydrophthalic anhydride, 3,6-endoxy-$\Delta^4$-tetrahydrophthalic anhydride, tetrachlorophthalic anhydride, maleic anhydride, chloromaleic anhydride, a-phenylmaleic anhydride, succinic anhydride and pyromellitic anhydride. Sensitivity can be enhanced by a factor of up to about 3 by incorporating the cyclic acid anhydrides in amounts of 1–15% of the total mass of the photosensitive composition. The print-out agent for providing visible image right after exposure may be exemplified by a system in which a photosensitive compound that releases an acid upon exposure is combined with a salt-forming organic dye.

Specific examples include the combination of o-naphthoquinone-diazide-4-sulfonic acid halogenides with salt-forming organic dyes that is described in JP-A-50-38209 and JP-A-53-8128, as well as the combination of trihalomethyl compounds with salt-forming organic dyes that is described in JP-A-53-36233, JP-A-54-74728, JP-A-60-3626, JP-A-61-143748, JP-A-61-151644 and JP-A-63-58440. Not only these salt-forming organic dyes but also other dyes can be used as image colorants. Suitable dyes including the salt-forming organic dyes are oil-soluble dyes and basic dyes.

Specific examples include Oil Yellow #101, Oil Yellow #103, Oil Pink #312, Oil Green BG, Oil Blue BOS, oil Blue

#603, Oil Black BY, Oil Black BS and Oil Black T-505 (all being the products of Orient Chemical Industry Co., Ltd.), Victoria Pure Blue, Crystal Violet (CI 42555), Methyl Violet (CI 42535), Rhodamine B (CI 45170B), Malachite Green (CI 42000) and Methylene Blue (CI 52015). The dyes described in JP-A-62-293247 are particularly preferred.

The photosensitive composition is applied to the support as dissolved in a suitable solvent that dissolves the ingredients described above. Exemplary solvents include ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, toluene, methyl acetate, ethyl acetate, methyl lactate, ethyl lactate, dimethyl sulfoxide, dimethylacetamide, dimethylformainide, water, N-methylpyrrolidone, tetrahydrofurfuryl alcohol, acetone, diacetone alcohol, methanol, ethanol, isopropanol, diethylene glycol and dimethyl ether. These solvents may be used in admixture.

When in solution, the above-mentioned ingredients (as the solids content) assume 2–50 wt %. The coating weight varies with the use and generally ranges from 0.5 to 3.0 g/m$^2$ in terms of the solids content. As the coating weight decreases, higher sensitivity to light is attained but, on the other hand, the physical properties of the photosensitive coat deteriorate.

In order to provide better applicability, the photosensitive composition incorporates surfactants such as fluorine-base surfactants of the types described in JP-A-62-170950. The content of the surfactants preferably ranges from 0.01 to 1%, more preferably from 0.05 to 0.5%, of the total mass of the photosensitive composition.

(B) Photosensitive layer composed of diazo resin and binder

Negative-acting photosensitive diazo compounds that can suitably be used in the invention are so-called "photosensitive diazo resins" which are the product of condensation between formaldehyde and a diphenylamine-p-diazonium salt which is the product of reaction between a diazonium salt and an organic condensing agent such as aldol or acetal that has a reactive carbonyl group (see U.S. Pat. Nos. 2,063,631 and 2,667,415).

Other useful condensed diazo compounds are described in JP-5-49-480001, JP-B-49-45322, JP-B-49-45323, etc. This type of photosensitive diazo compounds are usually obtained in the form of water-soluble inorganic salts and can, hence, be applied as aqueous solution. If desired, water-soluble diazo compounds may be reacted with aromatic or aliphatic compounds having at least one phenolic hydroxy group or sulfonyl group or both a phenolic hydroxy group and a sulfonyl group in accordance with the method described in JP-B-47-1167 and the resulting substantially insoluble photosensitive diazo resin is subsequently used.

The diazo resins are preferably contained in the photosensitive layer in amounts of 5–50 wt %. A smaller content of the diazo resins naturally leads to higher sensitivity to light but, on the other hand, the storage stability of the photosensitive layer decreases. An optimum content of the diazo resins is approximately between 8 and 20 wt %. While various polymers can be used as a binder, preferred are those which have functional groups such as hydroxy, amino, carboxy, amido, sulfonamido, active methylene, thioalcohol and epoxy groups.

Specific examples of such polymers include: the shellac described in BP 1,350,521; the polymers described in BP 1,460,978 and U.S. Pat. No. 4,123,276 which contain hydroxyethyl (meth)acrylate units as primary repeating units; the polyamide resins described in U.S. Pat. No. 3,751,257; the phenol resins described in BP 1,074,392; poly(vinyl acetal) resins such as poly(vinyl formal) resin and polylvinyl butyral) resin; the linear polyurethane resins described in U.S. Pat. No. 3,660,097; phthalated poly(vinyl alcohol) resins; epoxy resins prepared from bisphenol A and epichlorohydrin; polymers having amino groups such as polyaminostyrenes and polyalkylamino (meth) acrylates; and cellulose derivatives such as cellulose acetate, cellulose alkyl ethers and cellulose acetate phthalates.

The composition composed of the diazo resins and binders may further contain additives such as pH indicators of the types described in BP 1,041,463, the phosphoric acid and dyes described in U.S. Pat. No. 3,236,646.

The photosensitive layer preferably has a thickness of 0.1–30 $\mu$m, more preferably 0.5–10 $\mu$m. The amount (solids content) of the photosensitive layer to be provided on the support is typically within the range of from about 0.1 to about 7 g/m$^2$, preferably from 0.5 to 4 g/m$^2$.

The presensitized plate thus processed from the lithographic support of the invention is then subjected to imagewise exposure and subsequent treatments including development in the usual manner, whereupon a resin image is formed to prepare a lithographic printing plate.

Consider, for example, a positive-acting presensitized plate having the photosensitive layer (A). After imagewise exposure, development is effected with aqueous alkali solutions of the types described in U.S. Pat. No. 4,259,434 and JP-A-3-90388, whereupon the exposed areas of the presensitized plate are freed of the photosensitive layer to prepare a lithographic printing plate.

Consider next a negative-acting presensitized plate having the photosensitive layer (B) composed of a diazo resin and a binder. After imagewise exposure, the plate is treated with a liquid developer of the type described in U.S. Pat. No. 4,186,006, whereupon the unexposed areas of the plate are freed of the photosensitive layer to prepare a lithographic printing plate. In the case of the negative-acting presensitized plate described in JP-A-5-2273 or JP-A-4-219759, development may be done by treatment with an aqueous solution of an alkali metal silicate as described in those patents, whereby a lithographic printing plate is prepared.

EXAMPLES

The following examples are provided for the purpose of further illustrating the present invention but are in no way to be taken as limiting.

<Examples About the Lithographic Support According to the First Aspect of the Invention>

1. Producing Supports for Lithographic Printing Plates

Examples 1–8 and Comparative Examples 1–9

Aluminum alloy plates were prepared; they each contained 0.28 wt % Fe, 0.08 wt % Si, 0.030 wt % Ti and 0.012 wt % Mg; for their Cu and Ni contents, see Table 1.

The samples of Examples 1–4 and Comparative Examples 1–4 were processed by scheme A (in order from left to right in Table 2) and the samples of Examples 5–8 and Comparative Examples 5–9 by scheme B (in order from left to right in Table 2) to prepare supports for lithographic printing plates. Rinse was conducted between treatments.

In each of schemes A and B, the respective treatments were conducted under the following conditions.

Brush graining was performed with three No. 8 nylon brushes (bristle diameter, 0.5 mm) and a pumice stone suspension for 0.5 seconds at a rotating speed of 250 rpm.

Alkali etching was performed using an etching solution having a sodium hydroxide concentration of 26 wt %, an aluminum ion concentration of 6.5 wt % and a temperature of 65° C.

Electrolytic graining was performed with ac current using a liquid electrolyte having a sulfuric acid concentration of 1 wt % and an aluminum ion concentration of 0.5 wt %.

Anodization was performed with dc current using a 15 wt % sulfuric acid solution as a liquid electrolyte.

The lithographic supports prepared in Examples 1–4 and Comparative Examples 1–4 had average surface roughness Ra values of about 0.6 μm and those prepared in Examples 5–8 and Comparative Examples 5–9 had Ra values of about 0.3 μm.

The measurement of average surface roughness Ra was in accordance with "Arithmetic Average Roughness" in JIS B0601-1994 using SURFCOM of Tokyo Seimitsu Co., Ltd. as a surface roughness meter under the following conditions: cutoff value λc=0.8 mm; length of measurement=3.0 mm; vertical magnification=10,000; horizontal magnification=50; speed of measurement=0.3 mm/sec.

2. Evaluating Surface Quality

To evaluate the surface quality of each support sample, the extent of fine glossy areas of the surface was checked by visual inspection. The criteria for rating were as follows: ○, no fine glossy areas; X, very extensive fine glossy areas; ○Δ, Δ, ΔX, intermediate levels which changed for the worse in the indicated order. The samples rated ○Δ and ○ were found "acceptable". The surface quality of the supports can be regarded as equivalent to the surface quality of the nonimage areas of lithographic printing plates which were prepared from those supports.

3. Preparing Presensitized Plates

The lithographic supports prepared in Examples 1–8 and Comparative Examples 1–9 were coated with sensitizer composition A (for its recipe, see below) to give a dry coating weight of 2.5 g/m$^2$ and subsequently dried to prepare presensitized plates.

<Sensitizer Composition A>

| | |
|---|---|
| The product of esterification between naphthoquinone-1,2-diazido-5-sulfonyl chloride and pyrogallol-acetone resin (as described in Example 1 in U.S. Pat. No. 3,635,709) | 0.75 g |
| Cresol novolak resin | 2.00 g |
| Oleyl Blue #603 (product of Orient Chemical Industry Co., Ltd.) | 0.04 g |
| Ethylene dichloride | 16 g |
| 2-Methoxyethyl acetate | 12 g |

4. Development and Printing

Each of the presensitized plates was fixed in a vacuum printing frame, exposed for 50 seconds to a 3 kW metal halide lamp at a distance of 1 m through a transparent positive film and developed with a 5.26 wt % aqueous sodium silicate solution ($SiO_2/Na_2O$=1.74 in molar ratio; pH, 12.7) to prepare a lithographic printing plate. After the development, the plates were thoroughly washed with water and gummed before printing was done in the usual manner.

5. Evaluating Press Life and Stain Resistance

The prepared lith plates were evaluated for press life and stain resistance by the following methods.

(1) Press Life

The number of impressions that could be made before the solid image areas of each plate were found "blurred" by visual inspection was counted and the result was evaluated by 5-score rating;

○, 100,000 and more

○Δ, from 95,000 to less than 100,000

○, from 90,000 to less than 95,000

ΔX, from 85,000 to less than 90,000

X, less than 85,000

(2) Stain Resistance

Stain resistance was evaluated in terms of the stain of the blanket and the interlinking of halftone dots.

(i) Stain of the Blanket

After 1,000 impressions, the fouling of the blanket was examined visually and the result was evaluated by 5-score rating, ○, ○Δ, Δ, ΔX, X, in the increasing order of stain.

(ii) Interlinking of Halftone Dots

With the volume of fountain solution decreased stepwise, printing was done in the same manner as described above until the ink started to deposit between halftone dots in 50%-tint areas. The volume of the fountain solution that was applied at that time was measured as a threshold value and the result was evaluated by 5-score rating, ○, ○Δ, Δ, ΔX, X, in the increasing order of the threshold value.

In some print shops, the fountain solution is applied in substandard amounts. Even in that case, the ink should preferably not deposit between halftone dots. Therefore, the interlinking of halftone dots was used as a criterion for evaluation of stain resistance.

The results of evaluation of the surface quality, press life and stain resistance of each lithographic printing plate are shown in Table 1.

In the lithographic supports of the invention (Examples 1–8), the Cu and Ni contents were adjusted to satisfy relation (1) depending upon the average surface roughness Ra. As a result of graining, large deep pits were formed uniformly to leave only limited areas of the support surface unetched (undergained), so that the lithographic printing plates prepared from those supports were satisfactory in terms of surface quality, press life and stain resistance (as evaluated in terms of the fouling of the blanket and the interlinking of halftone dots).

When the Cu content was less than the lower limit specified by the invention, the lith plates were unsatisfactory in terms of press life and the interlinking of halftone dots (Comparative Examples 1, 5 and 6).

When the Cu and Ni contents did not satisfy relation (1), the lith plates were unsatisfactory in terms of either press life, the fouling of the blanket and the interlinking of halftone dots and, at the same time, they had poor surface quality (Comparative Examples 2–4 and 7).

The sample of Comparative Example 8 satisfied relation (1) but the Ni content was outside the range specified by the invention, so no uniform pits were formed and extensive fouling occurred on the blanket.

The sample of Comparative Example 9 also satisfied relation (1) but the Cu content was so large that unduly coarse pits were formed and the lith plates were unsatisfactory in terms of surface blanket, the fouling of the blanket and the interlinking of halftone dots.

TABLE 1

| | Ra (μm) | Ni content (wt %) | Cu content (wt %) | Relation (1) | Surface quality | Press life | Stain resistance: Fouling of blanket | Stain resistance: Interlocking of halftone dots |
|---|---|---|---|---|---|---|---|---|
| Example 1 | 0.6 | 0.005 | 0.010 | Satisfied | ○ | ○ | ○ | ○Δ |
| Example 2 | 0.6 | 0.01 | 0.012 | Satisfied | ○ | ○ | ○ | ○Δ |
| Example 3 | 0.6 | 0.10 | 0.02 | Satisfied | ○ | ○ | ○ | ○ |
| Example 4 | 0.6 | 0.20 | 0.03 | Satisfied | ○Δ | ○ | ○Δ | ○ |
| Example 5 | 0.3 | 0.005 | 0.005 | Satisfied | ○ | ○Δ | ○ | ○Δ |
| Example 6 | 0.3 | 0.01 | 0.007 | Satisfied | ○ | ○Δ | ○ | ○Δ |
| Example 7 | 0.3 | 0.10 | 0.015 | Satisfied | ○ | ○ | ○ | ○ |
| Example 8 | 0.3 | 0.20 | 0.03 | Satisfied | ○Δ | ○ | ○Δ | ○ |
| Comparative Example 1 | 0.6 | 0.005 | 0.003 | Not satisfied | Δ | X | ○ | ΔX |
| Comparative Example 2 | 0.6 | 0.01 | 0.005 | Not satisfied | ○ | X | ○ | ΔX |
| Comparative Example 3 | 0.6 | 0.10 | 0.012 | Not satisfied | ○ | ○Δ | ΔX | ○Δ |
| Comparative Example 4 | 0.6 | 0.20 | 0.02 | Not Satisfied | ΔX | ○Δ | ΔX | ○Δ |
| Comparative Example 5 | 0.3 | 0.005 | 0.001 | Not satisfied | ΔX | X | ○ | X |
| Comparative Example 6 | 0.3 | 0.01 | 0.002 | Not satisfied | ΔX | X | ○ | X |
| Comparative Example 7 | 0.3 | 0.10 | 0.010 | Not satisfied | ○ | X | ΔX | ○Δ |
| Comparative Example 8 | 0.3 | 0.001 | 0.03 | Satisfied | ○ | ○Δ | X | ○Δ |
| Comparative Example 9 | 0.3 | 0.01 | 0.05 | Satisfied | X | ○ | X | X |

TABLE 2

| Processing scheme | Brush graining | Alkali etching A1 dissolution ($g/m^2$) | Desmutting Nitric acid spray | Electrolytic graining Amount of electricity ($C/dm^2$) | Alkali etching A1 dissolution ($g/m^2$) | Desmutting Sulfuric acid spray | Anodization Coating weight ($g/m^2$) | Primer coat |
|---|---|---|---|---|---|---|---|---|
| A | Yes | 8 | Yes | 180 | 1.0 | Yes | 2.4 | β-alanine |
| B | No | 5.5 | Yes | 270 | 0.2 | Yes | 2.6 | No |

<Examples About the Lithographic Support According to the Second Aspect of the Invention>

1. Producing Supports for Lithographic Printing Plates

Examples 9–16 and Comparative Examples 10–12

Aluminum alloy plates were prepared; they each contained 0.35 wt % Fe, 0.10 wt % Si and 0.020 wt % Ti; for their Mg and Cu contents, see Table 3; they also contained at least one element selected from among In, Pb, Sn, Bi, Cr, Mn and Zn (for their contents, also see Table 3).

The samples of Examples 9–16 and Comparative Examples 10–12 were processed by scheme B (in order from left to right in Table 2) to prepare supports for lithographic printing plates. Rinse was conducted between treatments. The respective treatments in scheme B were conducted under the same conditions as in the Examples about the lith support according to the first aspect of the invention.

2. Preparing Presensitized Plates

The lithographic supports prepared in Examples 9–16 and Comparative Examples 10–12 were coated with sensitizer composition A (for its recipe, see above) to give a dry coating weight of 2.5 $g/m^2$ and subsequently dried to prepare presensitized plates.

3. Measuring the Quantity of Electricity Required to Form Pits in the Entire Plate Surface by Electrolytic Graining For each of the lithographic supports prepared in Examples 9–16 and Comparative Examples 10–12, the quantity of electricity required to form pits in the entire plate surface was investigated by performing electrolytic graining with varying quantities of electricity and examining the grained surface by SEM. The results were evaluated in relative values, with the value for Comparative Example 10 taken as unity.

4. Development and Printing

As in the Examples about the lithographic support according to the first aspect of the invention, the presensitized plates were exposed and developed to prepare lith plates, which were subsequently rinsed and gummed before printing was done.

5. Evaluating Press Life Before and After Application of Plate Cleaner

The prepared lith plates were evaluated for press life before and after application of a plate cleaner by the following methods.

(1) Press Life (Before Cleaner Application)

The number of impressions that could be made before the solid image areas of each plate were found "blurred" by visual inspection was counted. The results were evaluated in relative values, with the value for Comparative Example 10 taken as 100.

(2) Press Life (After Cleaner Application)

After 20,000 impressions, the solid image areas of each plate were cleaned five times with a liquid plate cleaner (MULTI-CLEANER of Fuji Photo Film Co., Ltd.) that was applied by means of a sponge. Printing was continued and the number of impressions that could be made before the solid image areas of each plate were found "blurred" by visual inspection was counted. The results were evaluated in relative values, with the press life of Comparative Example 10 before cleaner application being taken as 100.

The amount of electricity required to form pits over the entire surface of each lith support, as well as the press life of each lith plate before and after cleaner application are shown in Table 3. The lith supports of Examples 9–16 required smaller amounts of electricity to form pits over the entire surface and the lith plates prepared from those supports had satisfactory press life both before and after cleaner application.

TABLE 3

| | Mg addition (wt %) | Cu addition (wt %) | Additive element | Addition (wt %) | Amount of electricity required to form pits over the entire surface | Press life: Before cleaner application | Press life: After cleaner application |
|---|---|---|---|---|---|---|---|
| Example 9 | 0.010 | 0.020 | In | 0.003 | 0.9 | 100 | 95 |
| Example 10 | 0.010 | 0.020 | Pb | 0.003 | 0.9 | 100 | 95 |
| Example 11 | 0.010 | 0.020 | Sn | 0.003 | 0.9 | 100 | 95 |
| Example 12 | 0.010 | 0.020 | Bi | 0.003 | 0.9 | 100 | 95 |
| Example 13 | 0.010 | 0.020 | Cr | 0.003 | 0.9 | 100 | 95 |
| Example 14 | 0.010 | 0.020 | Mn | 0.003 | 0.95 | 100 | 95 |
| Example 15 | 0.010 | 0.020 | Zn | 0.003 | 0.85 | 100 | 95 |
| Example 16 | 0.010 | 0.020 | Zn + Mn | 0.006 | 0.85 | 105 | 100 |
| Comparative Example 10 | 0.010 | 0.020 | None | 0 | 1.0 | 100 | 70 |
| Comparative Example 11 | 0.000 | 0.020 | Zn | 0.003 | 1.0 | 95 | 80 |
| Comparative Example 12 | 0.010 | 0.001 | Zn | 0.003 | 0.9 | 90 | 80 |

<Examples About the Lithographic Support According to the Third Aspect of the Invention>

1. Producing Supports for Lithographic Printing Plates

Examples 17–28 and Comparative Examples 13–19

Aluminum alloy plates were prepared; they each contained 0.3 wt % Fe, 0.030 wt % Ti and 0.01 wt % Mg; for their Si and Cu contents, see Tables 4 and 5.

The samples of Examples 17–22 and Comparative Examples 13–16 were processed by scheme A (in order from left to right in Table 2) and the samples of Examples 23–28 and Comparative Examples 17–19 by scheme B (in order from left to right in table 2) to prepare supports for lithographic printing plates. Rinse was conducted between treatments.

Examples 29 and 30 and Comparative Examples 20 and 21

Aluminum alloy plates were prepared; they each contained 0.3 wt % Fe and 0.030 wt % Ti; for their Si, Cu and Mg contents, see Table 6.

The samples of Examples 29 and 30 and Comparative Example 20 were processed by scheme A (in order from left to right in Table 2) and the sample of Comparative Example 21 by scheme B (in order from left to right in Table 2) to prepare supports for lithographic printing plates. Rinse was conducted between treatments.

In each of schemes A and B, the respective treatments were conducted under the following conditions.

Brush graining was performed with three No. 8 nylon brushes (bristle diameter, 0.5 mm) and a pumice stone suspension for 0.5 seconds at a rotating speed of 250 rpm.

Alkali etching was performed using an etching solution having a sodium hydroxide concentration of 20 wt %.

Electrolytic graining was performed using a liquid electrolyte having a nitric acid concentration of 9 g/L.

Anodization was performed with dc current using a sulfuric acid solution (170 g/L) as a liquid electrolyte.

The primer coat was provided by applying a β-alanine containing primer to give a coating weight of 10 mg/m$^2$.

The lithographic supports prepared in Examples 17–22, 29 and 30 and Comparative Examples 13–16 and 20 had average surface roughness Ra values of about 0.6 μm and those prepared in Examples 23–28 and Comparative Examples 17–19 and 21 had values of about 0.3 μm.

The measurement of average surface roughness Ra was in accordance with JIS 50601-1982 under the following conditions: distance of measurement=3 mm; n=3.

2. Preparing Presensitized Plates

The lithographic supports prepared in Examples 17–30 and Comparative Examples 13–21 were coated with a sensitizer composition A (for its recipe, see above) to give a dry coating weight of 2.5 g/m$^2$ and subsequently dried to prepare presensitized plates.

3. Development and Printing

As in the Examples about the lithographic support according to the first aspect of the invention, the presensitized plates were exposed and developed to prepare lith plates, which were subsequently rinsed and gummed before printing was done.

4. Evaluating Press Life and Resistance to Aggressive Ink Stain

The prepared lith plates were evaluated for press life and resistance to aggressive ink stain by the following methods.

(1) Press Life

The number of impressions that could be made before the solid image areas of each plate were found "blurred" by visual inspection was counted. The results were evaluated by the following 5-score rating as contrasted with the value 100 for the control;

○, 100 and more

○Δ, from 95 to less than 100

Δ, from 90 to less than 95

ΔX, from 85 to less than 90

X, less than 85

(2) Resistance to Aggressive Ink Stain

During printing with a Cl-ion doped fountain solution, the plate was left to stand on the press more than once. The resulting stain of the non-image areas was observed visually and evaluated by the following 5-score rating;

○, no stain

○Δ, little stain

Δ, slight stain

ΔX, moderate stain

ΔX, extensive stain

The results of evaluation of press life and resistance to aggressive ink stain for the respective printing plates are shown in Tables 4–6. In the lithographic supports of Examples 17–30, the Cu content, Si content and average surface roughness Ra were adjusted to satisfy relation (2), so the lithographic printing plates prepared from those supports were satisfactory in both press life and resistance to aggressive ink stain.

Speaking of the lithographic supports of Comparative Examples 20 and 21, the Cu content, Si content and average surface roughness Ra were within the ranges specified by the invention and they also satisfied the relation (2). However, the Mg content of each of these supports was outside the range specified in the third aspect of the invention. Hence, those supports did not have pit uniformity and the lith plates prepared from them were unsatisfactory in press life and resistance to aggressive ink stain. Only when the Mg content of lith support was adjusted to lie within the range specified in the third aspect of the invention could pit uniformity be improved to such an extent that the lith plates prepared from the support were satisfactory in both press life and resistance to aggressive ink stain.

TABLE 4

| Example | Surface roughness Ra (μm) | Cu content (wt %) | Si content (wt %) | Value of left side | Value of right side | Decision | Press life | Resistance to aggressive ink stain |
|---|---|---|---|---|---|---|---|---|
| 17 | 0.6 | 0.005 | 0.08 | 0.07 | 0.155 | ○ | ○Δ | ○ |
| 18 | 0.6 | 0.005 | 0.15 | 0.07 | 0.155 | ○ | ○ | ○Δ |
| 19 | 0.6 | 0.02 | 0.05 | 0.04 | 0.14 | ○ | ○ | ○ |
| 20 | 0.6 | 0.02 | 0.13 | 0.04 | 0.14 | ○ | ○ | ○ |
| 21 | 0.6 | 0.04 | 0.04 | 0 | 0.12 | ○ | ○ | ○ |
| 22 | 0.6 | 0.04 | 0.11 | 0 | 0.12 | ○ | ○ | ○ |
| 23 | 0.3 | 0.005 | 0.10 | 0.10 | 0.185 | ○ | ○Δ | ○ |
| 24 | 0.3 | 0.005 | 0.17 | 0.10 | 0.185 | ○ | ○ | ○Δ |
| 25 | 0.3 | 0.02 | 0.07 | 0.07 | 0.17 | ○ | ○ | ○ |
| 26 | 0.3 | 0.02 | 0.15 | 0.07 | 0.17 | ○ | ○ | ○Δ |
| 27 | 0.3 | 0.04 | 0.04 | 0.03 | 0.15 | ○ | ○ | ○ |
| 28 | 0.3 | 0.04 | 0.13 | 0.03 | 0.15 | ○ | ○ | ○Δ |

Value of left side: $-2[Cu] + 0.14 - [Ra]/10$
Value of right side: $-[Cu] + 0.22 - [Ra]/10$
Decision: ○ if relation (2) is satisfied and X if not.

TABLE 5

| Comparative Example | Surface roughness Ra (μm) | Cu content (wt %) | Si content (wt %) | Value of left side | Value of right side | Decision | Press life | Resistance to aggressive ink stain |
|---|---|---|---|---|---|---|---|---|
| 13 | 0.6 | 0.005 | 0.005 | 0.07 | 0.155 | X | X | ○ |
| 14 | 0.6 | 0.005 | 0.20 | 0.07 | 0.155 | X | ○Δ | X |
| 15 | 0.6 | 0.02 | 0.15 | 0.04 | 0.14 | X | ○ | X |
| 16 | 0.6 | 0.04 | 0.13 | 0 | 0.12 | X | ○ | X |
| 17 | 0.3 | 0.005 | 0.06 | 0.10 | 0.185 | X | X | ○ |
| 18 | 0.3 | 0.005 | 0.20 | 0.10 | 0.185 | X | ΔX | ΔX |
| 19 | 0.3 | 0.02 | 0.05 | 0.07 | 0.17 | X | ΔX | ○ |

Value of left side: $-2[Cu] + 0.14 - [Ra]/10$
Value of right side: $-[Cu] + 0.22 - [Ra]/10$
Decision: ○ if relation (2) is satisfied and X if not.

TABLE 6

| | Surface roughness Ra (μm) | Cu content (wt %) | Si content (wt %) | Mg content (wt %) | Value of left side | Value of right side | Decision | Press life | Resistance to aggressive ink stain |
|---|---|---|---|---|---|---|---|---|---|
| Example 18 | 0.6 | 0.005 | 0.15 | 0.01 | 0.07 | 0.155 | ○ | ○ | ○Δ |
| Example 22 | 0.6 | 0.04 | 0.11 | 0.01 | 0 | 0.12 | ○ | ○ | ○ |
| Example 25 | 0.3 | 0.02 | 0.07 | 0.01 | 0.07 | 0.17 | ○ | ○ | ○ |
| Example 29 | 0.6 | 0.02 | 0.07 | 0.005 | 0.04 | 0.14 | ○ | ○ | ○ |
| Example 30 | 0.6 | 0.017 | 0.06 | 0.002 | 0.046 | 0.143 | ○ | ○Δ | ○ |
| Comparative Example 14 | 0.6 | 0.005 | 0.20 | 0.01 | 0.07 | 0.155 | X | ○Δ | X |

TABLE 6-continued

| | Surface roughness Ra (μm) | Cu content (wt %) | Si content (wt %) | Mg content (wt %) | Value of left side | Value of right side | Decision | Press life | Resistance to aggressive ink stain |
|---|---|---|---|---|---|---|---|---|---|
| Comparative Example 16 | 0.6 | 0.04 | 0.13 | 0.01 | 0 | 0.12 | X | ○ | X |
| Comparative Example 19 | 0.3 | 0.02 | 0.05 | 0.01 | 0.07 | 0.17 | X | ΔX | ○ |
| Comparative Example 20 | 0.6 | 0.017 | 0.06 | <0.001 | 0.046 | 0.143 | ○ | ΔX | ○Δ |
| Comparative Example 21 | 0.3 | 0.017 | 0.08 | <0.001 | 0.076 | 0.173 | ○ | ΔX | Δ |

Value of left side: −2[Cu] + 0.14 − [Ra]/10
Value of right side: −[Cu] + 0.22 − [Ra]/10
Decision: ○ if relation (2) is satisfied and X if not.

The lithographic printing plates prepared from the supports of the invention have long press life.

The lithographic support according to the first aspect of the invention has the advantage that large deep pits are formed uniformly by electrolytic graining so that when it is processed into a lithographic printing plate, it adheres so strongly to the photosensitive layer that the plate exhibits prolonged press life. Since the pits formed in the support are large and deep, it can be processed into lithographic printing plates that have sufficiently large water holding capacity to exhibit high stain resistance. As a further advantage, the pits are formed uniformly to leave no undergrained areas, so the lithographic printing plates prepared from the support have good surface quality.

The lithographic support according to the second aspect of the invention has the advantage of not only possessing pits of a desired depth and diameter but also having the pits of uniform depth and diameter distributed at a desired density across the support surface. Therefore, the lithographic printing plates prepared from the support have satisfactory press life both before and after application or a plate cleaner. In addition, the desired pits can be formed with a small enough amount of electricity to achieve a significant reduction in the cost of electrolysis.

The lithographic support according to the third aspect of the invention has the advantage that wavy asperities and pits can be generated without any unevenness in shape and size so that the grained surface has sufficient uniformity to ensure strong adhesion between the photosensitive layer and the support. Therefore, the lithographic printing plates prepared from this support are satisfactory in terms of not only press life and resistance to aggressive ink stain but also water holding capacity and mountability on the press.

What is claimed is:

1. A support for a lithographic printing plate which is obtained by performing surface roughening treatment including electrochemical graining on an aluminum alloy plate containing 0.2–0.5 wt % of Fe, 0.04–0.20 wt % of Si, 0.005–0.040 wt % of Cu, 0.010–0.040 wt % of Ti, 0.001–0.020 wt % of Mg and 0.005–0.2 wt % of Ni, with the balance being Al and an incidental impurity, and which satisfies the following relation (1):

$$[Ni]/10+[Ra]/100 \leqq [Cu] \quad (1)$$

where [Ni] and [Cu] are the Ni and Cu contents (wt %), respectively, of said aluminum alloy plate, and [Ra] is the average surface roughness Ra (μm) of the roughened support surface.

2. The support for a lithographic printing plate according to claim 1, wherein said surface roughening treatment further comprises a mechanical graining and/or a chemical graining.

3. A presensitized plate comprising the support for a lithographic printing plate according to claim 1 and a photosensitive layer thereof.

4. A support for a lithographic printing plate which is obtained by performing surface roughening treatment including electrochemical graining and anodization on an aluminum alloy plate containing 0.2–0.5 wt % of Fe, 0.04–0.20 wt % of Si, 0.005–0.040 wt % of Cu, 0.010–0.040 wt % of Ti and 0.002–0.020 wt % of Mg, with the balance being Al and an incidental impurity, and which has an average surface roughness Ra of 0.2–2.0 μm after said roughening treatment and which satisfies the following relation (2):

$$-2[Cu]+0.14-[Ra]/10 \leqq [Si] \leqq -(Cu)+0.22-[Ra]/10 \quad (2)$$

where [Si] and [Cu] are the Si and Cu contents (wt %), respectively, of said aluminum alloy plate, and [Ra] is the average surface roughness Ra (μm) of the roughened support surface.

5. The support for a lithographic printing plate according to claim 4, wherein said surface roughening treatment further comprises a mechanical graining and/or a chemical graining.

6. A presensitized plate comprising the support for a lithographic printing plate according to claim 4 and a photosensitive layer thereof.

* * * * *